US009631404B2

(12) United States Patent
Takagi et al.

(10) Patent No.: US 9,631,404 B2
(45) Date of Patent: Apr. 25, 2017

(54) VEHICLE DOOR LOCK APPARATUS

(75) Inventors: Masaharu Takagi, Nagoya (JP); Satoshi Yamaji, Nagoya (JP)

(73) Assignee: ANSEI CORPORATION, Obu (JP)

( * ) Notice: Subject to any disclaimer, the term of this patent is extended or adjusted under 35 U.S.C. 154(b) by 437 days.

(21) Appl. No.: 14/344,260

(22) PCT Filed: Sep. 27, 2011

(86) PCT No.: PCT/JP2011/071992
§ 371 (c)(1),
(2), (4) Date: Mar. 11, 2014

(87) PCT Pub. No.: WO2013/046317
PCT Pub. Date: Apr. 4, 2013

(65) Prior Publication Data

US 2014/0346786 A1 Nov. 27, 2014

(51) Int. Cl.

| | |
|---|---|
| ***E05C 3/06*** | (2006.01) |
| ***E05B 85/00*** | (2014.01) |
| ***E05B 77/06*** | (2014.01) |
| ***E05B 85/24*** | (2014.01) |
| ***E05B 77/32*** | (2014.01) |
| *E05B 81/06* | (2014.01) |

(52) U.S. Cl.
CPC ..... *E05B 85/00* (2013.01); *E05B 77/06* (2013.01); *E05B 77/32* (2013.01); *E05B 85/243* (2013.01); *E05B 81/06* (2013.01); *Y10T 292/108* (2015.04)

(58) Field of Classification Search
CPC ..... E05B 81/14; E05B 85/26
USPC ..... 292/201, 216, 336.3, DIG. 23
See application file for complete search history.

(56) References Cited

U.S. PATENT DOCUMENTS

| | | | |
|---|---|---|---|
| 2,864,641 | A | 12/1958 | Leslie |
| 3,799,596 | A | 3/1974 | Nozomu et al. |
| 4,536,021 | A | 8/1985 | Mochida |
| 5,769,471 | A | 6/1998 | Suzuki et al. |
| 5,865,481 | A | 2/1999 | Buschmann |
| 6,698,262 | B2 | 3/2004 | Wittwer |
| 2003/0234544 | A1 | 12/2003 | Jankowski et al. |
| 2004/0245786 | A1 | 12/2004 | Hashiba et al. |
| 2007/0085349 | A1 | 4/2007 | Merideth et al. |

(Continued)

FOREIGN PATENT DOCUMENTS

| | | | |
|---|---|---|---|
| CN | 1122870 | A | 5/1996 |
| EP | 1375794 | A | 1/2004 |

(Continued)

*Primary Examiner* — Matthew Ing
(74) *Attorney, Agent, or Firm* — J-Tek Law PLLC; Jeffrey D. Tekanic; Scott T. Wakeman

(57) ABSTRACT

A vehicle door lock apparatus includes a housing, a fork in the housing, a pawl selectively preventing pivoting movement of the fork, a first lever having one end coupleable to a door handle and a second lever pivotably supported at a second end of the first lever and shiftable from a first position to a second position by application of inertial force. When the first lever pivots and the second lever is in the first position the second lever comes into contact with the pawl and releases the fork and when the second lever is in the second position it moves with the first lever independently of the pawl. A third lever selectively places the second lever in the second position and a retention device prevents the second lever from moving the pawl when first lever moves and the third lever is holding the second lever in the second position.

15 Claims, 11 Drawing Sheets

(56) References Cited

U.S. PATENT DOCUMENTS

| | | | |
|---|---|---|---|
| 2009/0079208 | A1 | 3/2009 | Mizuno et al. |
| 2012/0110920 | A1 | 5/2012 | Takagi et al. |

FOREIGN PATENT DOCUMENTS

| | | | |
|---|---|---|---|
| JP | 2005120764 | A | 5/2005 |
| JP | 2005146746 | A | 6/2005 |
| JP | 2009084994 | A | 4/2009 |
| JP | 2011017172 | A | 1/2011 |
| JP | 2011026780 | A | 2/2011 |

VEHICLE DOOR LOCK APPARATUS

CROSS-REFERENCE

This application is the US national stage of International Patent Application No. PCT/JP2011/071992 filed on Sep. 27, 2011.

TECHNICAL FIELD

The present invention relates to a vehicle door lock apparatus.

BACKGROUND ART

Conventional vehicle door lock apparatuses are disclosed in Patent Literatures 1 and 2. These vehicle door lock apparatuses include a housing provided in a door for opening and closing an opening of a vehicle body and including an entry opening that a striker fixed to the vehicle body enters, a fork pivotably provided in the housing and switched to a latched state for locking the striker in the entry opening or an unlatched state for unlocking the striker in the entry opening, and a pawl pivotably provided in the housing and capable of fixing or releasing the pivoting movement of the fork.

The vehicle door lock apparatus disclosed in Patent Literature 1 includes a first lever pivotably provided in the housing and one end side of which is coupled to a door handle, a second lever pivotably supported, on the other end side of the first lever, around a pivot extending in a direction orthogonal to a direction of advancing to and retracting from the opening, and a biasing member provided between the housing and the second lever. In FIG. 1 and the like of Patent Literature 1, the first lever is shown as reference numeral 14, the second lever is shown as reference numeral 48, and the biasing member is shown as reference numeral 52. The first lever pivots by an opening operation of the door handle. The second lever is pivotable from a first position to a second position by application of inertial force at the time of, for example, a vehicle collision. The biasing member biases the second lever toward the first position.

In this vehicle door lock apparatus, when the first lever pivots, the second lever which is usually disposed in the first position comes into contact with the pawl and release the pivoting movement of the fork, so that the fork in the latched state is switched to the unlatched state. On the other hand, at the time of, for example, the vehicle collision, the second lever is displaced to the second position while resisting a biasing force of the biasing member and separates from the pawl; therefore, even if the first lever pivots, the fork in the latched state is not switched to the unlatched state. In this way, the vehicle door lock apparatus disclosed in Patent Literature 1 attains prevention of an unintended opening of the door at the time of, for example, the vehicle collision.

On the other hand, the vehicle door lock apparatus disclosed in Patent Literature 2 includes an open member coupled to a door handle and displaced by the opening operation of the door handle, a linking member displaced to come into contact with a pawl and release pivoting movement of a fork, a transmitting member coupled to a locking knob and, in the case in which the locking knob is in an unlocked state, displaced to a transmittable position for transmitting the displacement of the open member to the linking member and, on the other hand, in the case in which the locking knob is in a locked state, displaced to an un-transmittable position where the displacement of the open member is not transmitted to the linking member, and a motion accumulating mechanism interposed between the transmitting member and the locking knob.

As shown in FIG. 2 and the like of Patent Literature 2, the motion accumulating mechanism is configured to, in the case in which an unlocking operation of the locking knob and the opening operation of the door handle overlap, when the displacement of the transmitting member is prevented while the transmitting member is displaced from the un-transmittable position to the transmittable position, accumulate motions of the locking knob thereafter and, when the displacement of the transmitting member is not prevented, displace the transmitting member to the transmittable position. In this way, even when the unlocking operation and the opening operation of the door overlap, the vehicle door lock apparatus disclosed in Patent Literature 2 eliminates the need to perform the unlocking operation of the locking knob again.

CITATION LIST

Patent Literature

Patent Literature 1: EP1375794A2
Patent Literature 2: Japanese Patent Application Laid-Open No. 2005-120764

SUMMARY OF THE INVENTION

Incidentally, it is conceivable that a mechanism same as the motion accumulating mechanism of the vehicle door lock apparatus of Patent Literature 2 is provided in the vehicle door lock apparatus of Patent Literature 1 to realize, in addition to prevention of the unintentional opening of the door at the time of, for example, the vehicle collision, elimination of the need to perform the unlocking operation again when the unlocking operation and the opening operation of the door overlap. However, in this case, it is difficult to reduce manufacturing costs because of an increase in the number of components and complication of assembly work.

The present invention has been devised in view of the aforementioned conventional circumstances and an object of the present invention is to provide a vehicle door lock apparatus that can reduce manufacturing costs while realizing prevention of an unintentional opening of the door at the time of, for example, a vehicle collision and elimination of the need to perform unlocking operation again when the unlocking operation and opening operation of the door overlap.

A vehicle door lock apparatus according to the present invention includes:

a housing provided in a door for opening and closing an opening of a vehicle body and including an entry opening that a striker fixed to the vehicle body enters;

a fork pivotably provided in the housing and switched to a latched state for locking the striker in the entry opening or an unlatched state for unlocking the striker in the entry opening;

a pawl pivotably provided in the housing and capable of fixing or releasing the pivoting movement of the fork;

a first lever pivotably provided in the housing, one end side of which is coupled to a door handle, and configured to pivot by an opening operation of the door handle;

a second lever pivotably supported on the other end side of the first lever around a pivot extending in a direction orthogonal to a direction of advancing to and retracting from the opening, enabled to pivot from a first position to a second position by application of inertial force greater than a preset value, and configured to, when the first lever pivots, in the first position, come into contact with the pawl and release the pivoting movement of the fork and, on the other hand, in the second position, separate from the pawl;

a biasing member configured to bias the second lever to the first position;

a third lever provided in the housing, enabled to be displaced to a third position for allowing the second lever to be disposed in the first position and the second position and a fourth position for retaining the second lever in the second position, and configured to, in the third position, switch the vehicle door lock apparatus to an unlocked state in which the fork in the latched state can be switched to the unlatched state and, on the other hand, in the fourth position, switch the vehicle door lock apparatus to a locked state in which the fork in the latched state cannot be switched to the unlatched state; and a retention device provided in the housing and configured to, when the first lever is about to pivot in a state in which the second lever is disposed in the second position, allow the pivoting movement of the first lever while retaining the second lever in the second position irrespective of the position of the third lever (claim 1).

In the vehicle door lock apparatus in the present invention, the second lever is normally biased by the biasing member and disposed in the first position. Therefore, when the first lever pivots due to the opening operation of the door handle, the second lever disposed in the first position comes into contact with the pawl and the pivoting movement of the first lever is transmitted to the pawl. Then, since the pawl releases the pivoting movement of the fork, the fork is switched from the latched state to the unlatched state.

In the vehicle door lock apparatus, the second lever pivots, while resisting the biasing force of the biasing member, from the first position to the second position around the pivot by application of the inertial force greater than the preset value. That is, when the door or the vehicle body receives an impact in the direction of advancing to and retracting from the opening of the vehicle due to, for example, the vehicle collision, inertial force is applied on the second lever in a direction opposite to the direction of the impact. When the inertial force is greater than the preset value, the second lever pivots from the first position to the second position in the direction opposite to the direction of the impact around the pivot which extends in the direction orthogonal to the direction of advancing to and retracting from the opening. Therefore, even if the first lever pivots unintentionally, the vehicle door lock apparatus is in a "swing-and-miss state" in which the second lever in the second position avoids contact with the pawl. In this way, since the pivoting movement of the first lever is not transmitted to the pawl, the pawl keeps the pivoting movement of the fork fixed, and the fork is not switched from the latched state to the unlatched state.

In the vehicle door lock apparatus in the present invention, since the third lever is displaced to the third position or the fourth position and a relative relation between the third lever and the second lever changes, it is possible to switch the vehicle door lock apparatus to the unlocked state and the locked state. In the case in which the unlocking operation and the opening operation of the door overlap, the displacement of the third lever from the fourth position to the third position and the pivoting movement of the first lever overlap. Even in this case, the retention device allows the pivoting movement of the first lever while retaining the second lever, which is biased by the biasing member and about to be displaced to the first position, in the second position irrespective of the position of the third lever. Therefore, the second lever remains separate from the pawl without functioning as a "stopper rod" for restraining the pivoting movement of the first lever. As a result, even if the first lever pivots, the second lever does not come into contact with the pawl and the opening operation of the door is invalidated. On the other hand, the third lever is displaced from the fourth position to the third position without being prevented by the first lever and the second lever and achieves a state in which the fork in the latched state can be switched to the unlatched state. In this way, the third lever switches the vehicle door lock apparatus to an unlocked state. Therefore it is unnecessary to perform the unlocking operation again. When the first lever returns to its original position, the second lever is biased by the biasing member and displaced to the first position. At this time, the third lever in the third position allows the displacement. Therefore, in the case in which the opening operation of the door 2 is performed next, the second lever displaced to the first position can surely come into contact with the pawl.

Further, in the vehicle door lock apparatus in the present invention, the second lever serves as all of a member that comes into contact with the pawl due to the opening operation of the door, a member that is separated from the pawl by inertial force at the time of, for example, the vehicle collision, and a member that eliminates the need to perform the unlocking operation again in the case in which the unlocking operation and the opening operation of the door overlap. Only one biasing member is sufficient for the second lever which serves as the three members. Therefore, in the vehicle door lock apparatus, it is possible to realize a reduction in the number of components and simplification of assembly work and thus realize a reduction in manufacturing costs.

Therefore, in the vehicle door lock apparatus in the present invention, it is possible to reduce manufacturing costs while realizing prevention of the unintentional opening of the door at the time of, for example, the vehicle collision and elimination of the need to perform the unlocking operation again when the unlocking operation and the opening operation of the door overlap. In the vehicle door lock apparatus, it is also possible to realize a reduction in size because only one biasing member is sufficient for the second lever which serves as the three members.

In the vehicle door lock apparatus in the present invention, it is preferable that the third lever is configured to move linearly in a first direction substantially parallel to a direction in which the pivot is displaced according to the pivoting movement of the first lever and to be displaced to the third position or the fourth position (claim 2). With this configuration, it is possible to reduce a space occupied by the third lever and realize a reduction in size of the apparatus.

In the vehicle door lock apparatus in the present invention, it is preferable that the third lever includes a first guide surface extending in the first direction and a second guide surface continuing to the first guide surface, orthogonal to the pivot, and bending to swell in a direction approaching the second lever. It is preferable that the first guide surface is configured to, when the third lever is disposed in the third position, retain the second lever in the first position in a slide contact manner and allow the second lever to pivot to the second position when the second lever is being displaced according to the pivoting movement of the first lever. It is preferable that the second guide surface is configured to, when the third lever is disposed in the fourth position, come into contact with the second lever and retain the second lever in the second position (claim 3). With this configuration, it is possible to simplify the apparatus configuration and realize a further reduction in manufacturing costs due to the lever having the specific configuration explained above.

In the vehicle door lock apparatus in the present invention, it is preferable that the housing includes a base plate in which an entry opening is formed and a back plate facing the base plate. It is preferable that the fork and the pawl are pivotably supported in a state in which the fork and the pawl are sandwiched by the base plate and the back plate. It is preferable that the retention device is an end edge of the back plate facing the second lever (claim 4). With this configuration, it is possible to easily form the retention device, and therefore it is possible to realize a further reduction in manufacturing costs.

BRIEF DESCRIPTION OF THE DRAWINGS

FIG. 3 is an exploded perspective view of the vehicle door lock apparatus in the embodiment, showing a housing, a fork, a pawl, a first lever, a second lever, a third lever, a retention device, and the like.

EMBODIMENTS FOR CARRYING OUT THE INVENTION

An embodiment that embodies the present invention is explained below with reference to the drawings.

Embodiment

Figure 1:
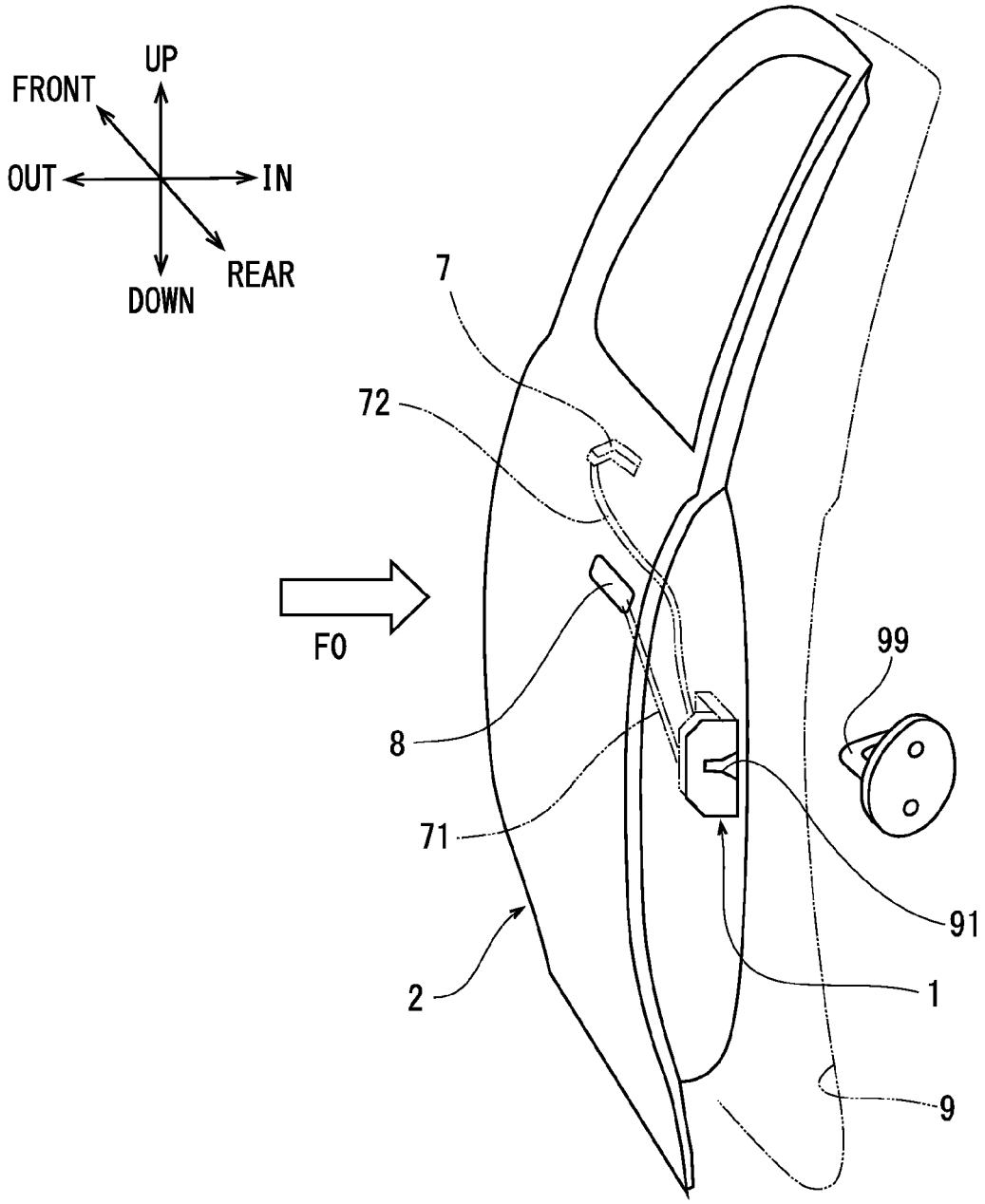
FIG. 1 is a schematic perspective view of a vehicle door applied with a vehicle door lock apparatus in an embodiment.

As shown in FIG. 1, a vehicle door lock apparatus 1 in an embodiment (hereinafter simply referred to as "door lock apparatus 1") is applied to vehicles such as an automobile, a bus, and an industrial vehicle. The door lock apparatus 1 is disposed on a rear end side of a door 2 for opening and closing an opening 9 provided on a left side face of a vehicle body.

More specifically, an exterior door handle 8 is disposed on a rear outer surface of the door 2 and an interior door handle 7 is disposed on an inner surface of the door 2. The door lock apparatus 1 is disposed below the exterior door handle 8 on the inside of the door 2. An entry opening 91 of the door lock apparatus 1 is exposed on a rear end face of the door 2. When the door lock apparatus 1 moves according to the opening and closing of the door 2, a striker 99 having a substantial "U" shape relatively enters the entry opening 91. The door lock apparatus 1 is coupled to the exterior door handle 8 via a rod 71 and connected to the interior door handle 7 via a cable 72.

Figure 2:
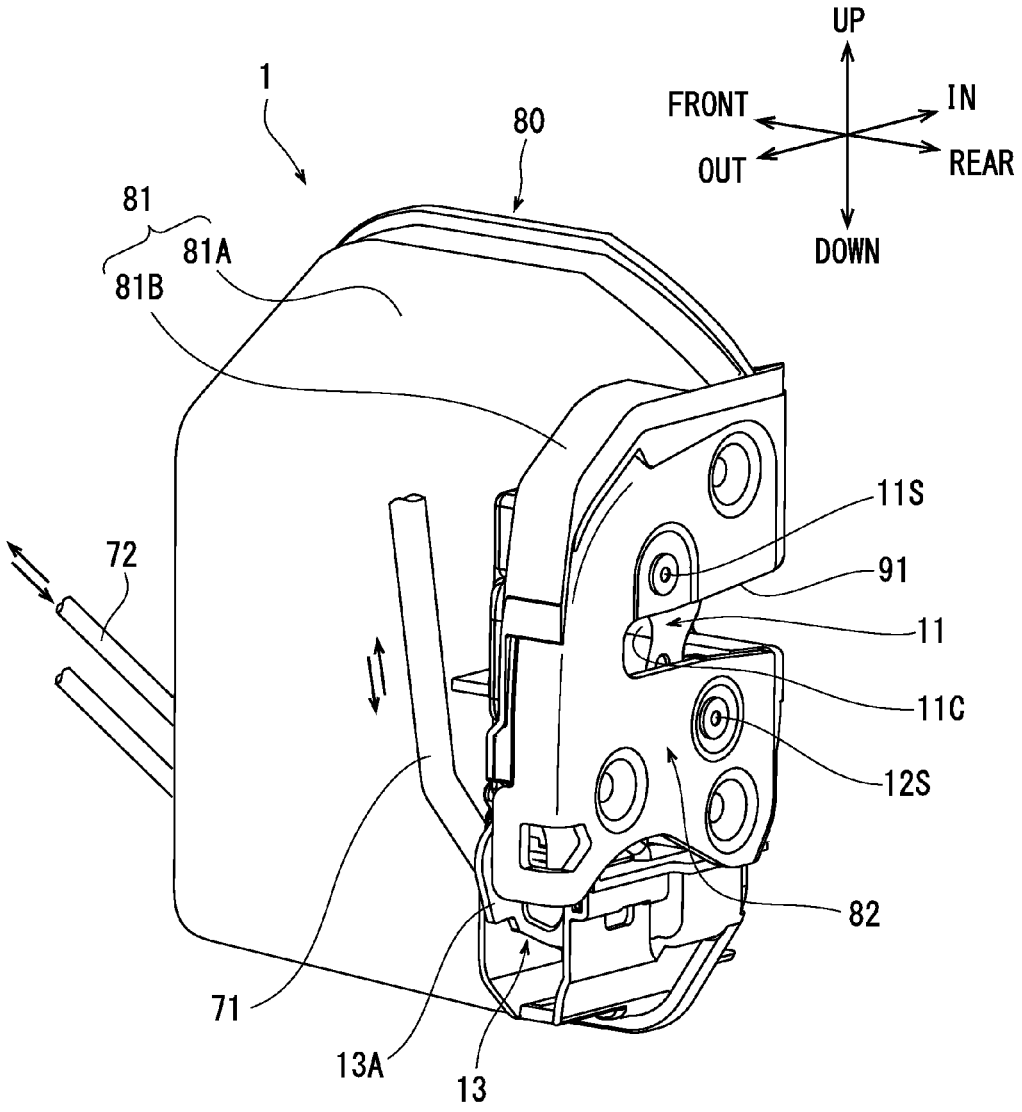
FIG. 2 is a perspective view of the vehicle door lock apparatus in the embodiment.

Note that all of the front-rear direction, the up-down direction, and the in-out direction shown in FIG. 2 and subsequent drawings correspond to those in FIG. 1. Although this embodiment exemplifies a case in which the door lock apparatus 1 is provided in a left side door, in the case of a right side door, the door lock apparatus 1 is simply symmetrical to the door lock apparatus 1 of this embodiment. Further, the door lock apparatus 1 can also be provided in a vehicle door, a tail gate, and the like that open and close in a sliding manner.

The configuration of the door lock apparatus 1 is explained in detail below. As shown in FIGS. 2 to 5, the door lock apparatus 1 includes a housing 80 disposed on an inside of the rear end side of the door 2 and a fork 11, a pawl 12, an open lever 13, an inertial lever 30, a lock lever 50, and the like provided in the housing 80. The open lever 13 is an example of the "first lever" in the present invention. The inertial lever 30 is an example of the "second lever" in the present invention. The lock lever 50 is an example of the "third lever" in the present invention.

Figure 3:
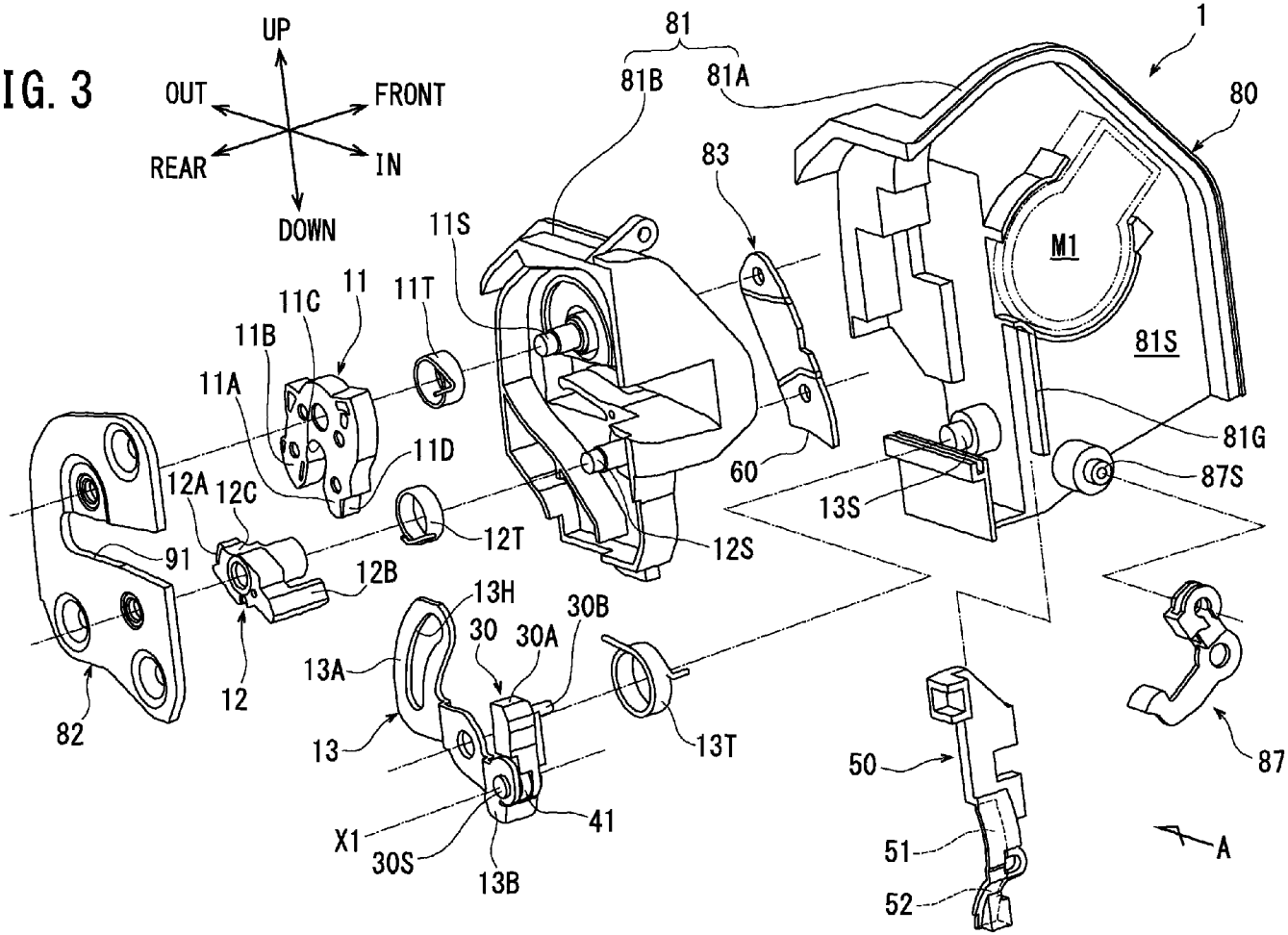

The housing 80 is configured by a main housing 81, a base plate 82, a back plate 83, and the like. As shown in FIG. 3, the main housing 81 is configured by combining a first housing member 81A and a second housing member 81B made of resin. The main housing 81 includes an internal space 81S that opens to a vehicle inner side and a rear side. The vehicle inner side of the internal space 81S is closed by a not-shown cover member and the rear side of the internal space 81S is closed by the base plate 82. The entry opening 91, which has been cut out deeply in a groove shape from the vehicle inner side toward the outer side, is formed in the base plate 82.

Figure 4:
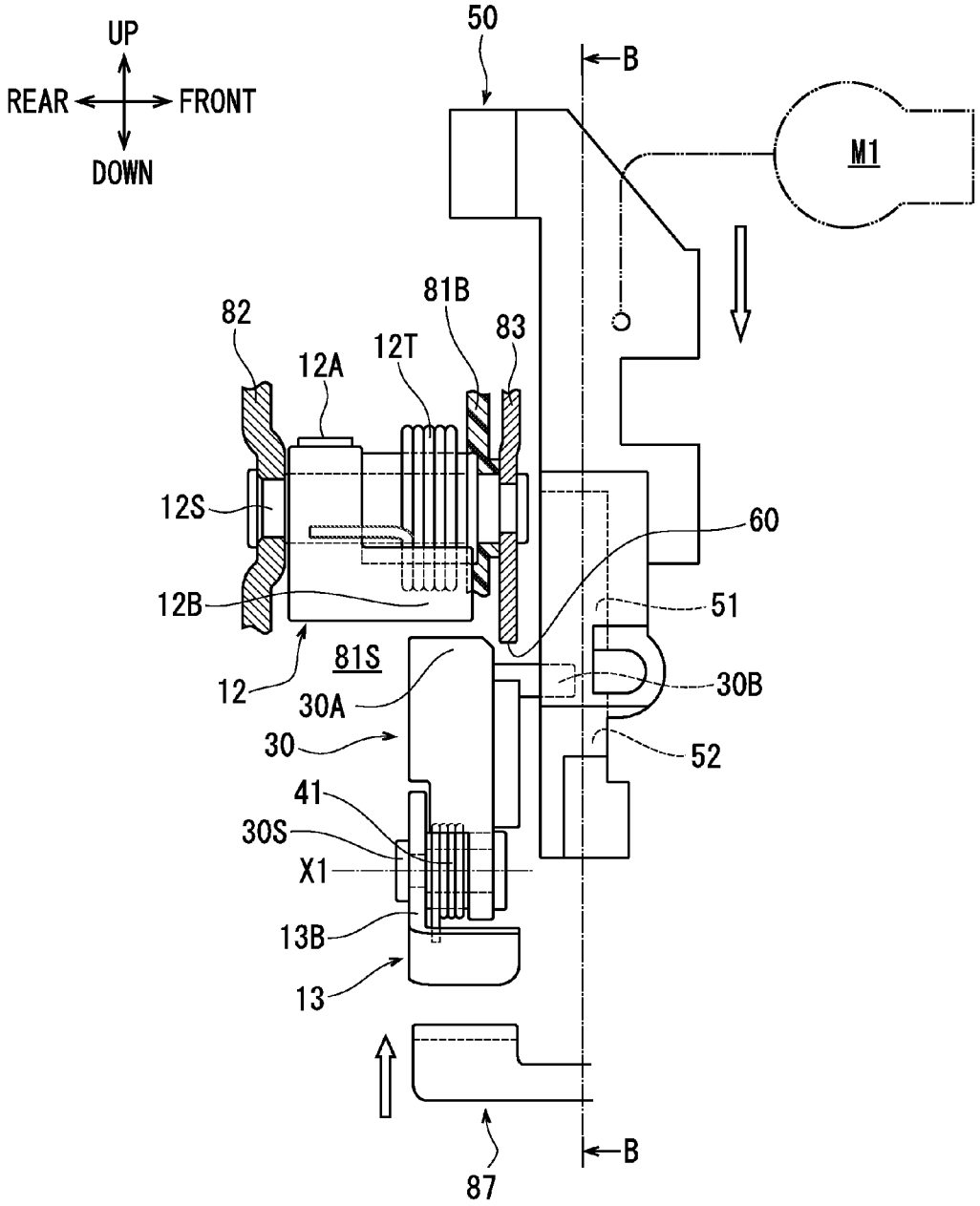
FIG. 4 is a schematic diagram of the vehicle door lock apparatus in the embodiment, extracting and showing the fork, the pawl, the first to third levers, the retention device, and the like viewed from the direction of arrow A in FIG. 3 (in a state in which the third lever is disposed in a third position).

As shown in FIG. 3 and FIG. 4, the back plate 83 made of a metal steel plate is attached to a front surface side of the second housing member 81B. The back plate 83 is positioned in the internal space 81S and faces the base plate 82.

Figure 5:
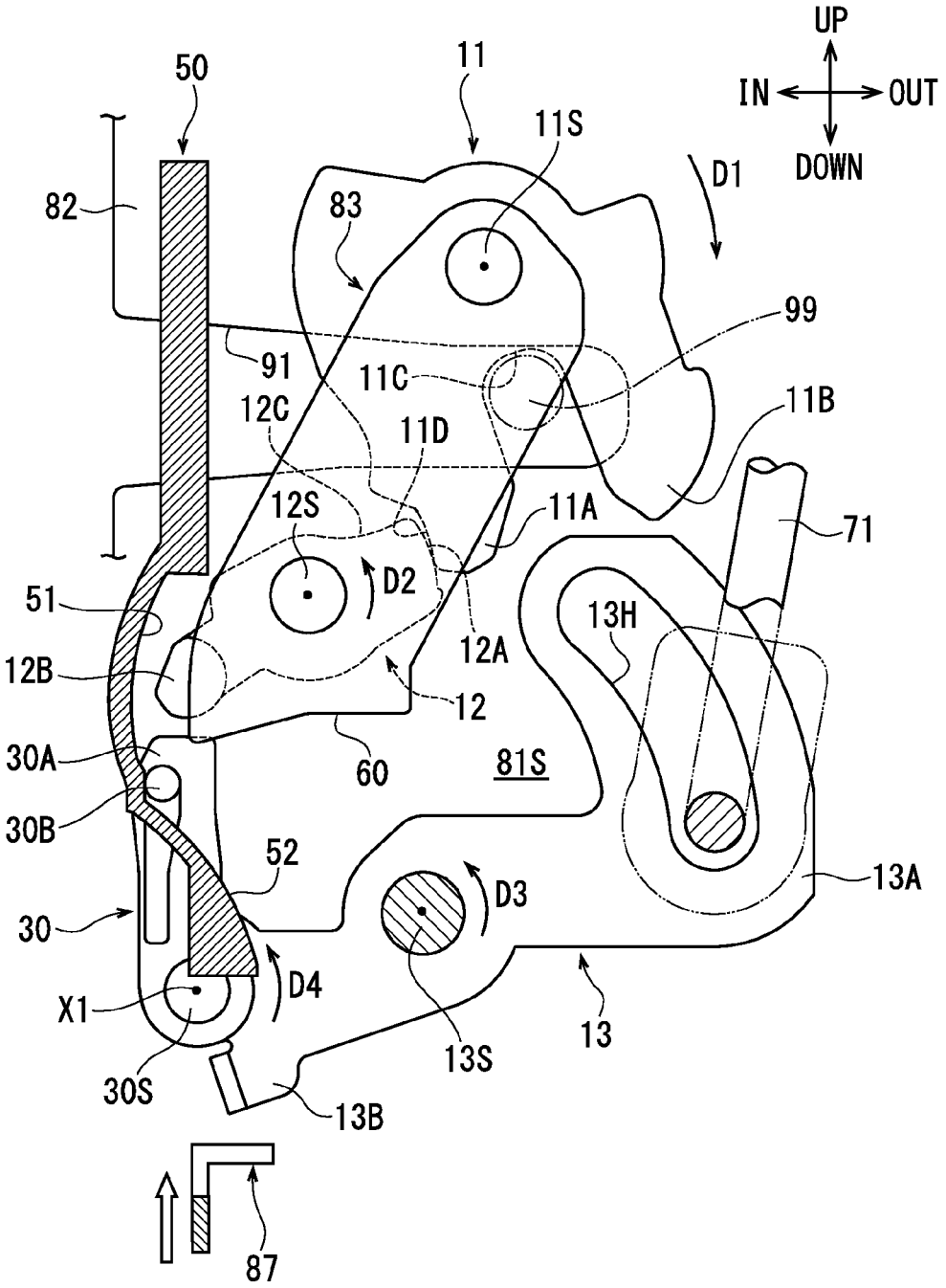
FIG. 5 is a schematic sectional view of the vehicle door lock apparatus in the embodiment, showing the fork, the pawl, the first to third levers, the retention device, and the like viewed along section B-B in FIG. 4.

As shown in FIG. 3, a fork pivot shaft 11S and a pawl pivot shaft 12S which extend in the front-rear direction are provided in the internal space 81S. As shown in FIG. 5, the fork pivot shaft 11S is positioned above the entry opening 91 and the pawl pivot shaft 12S is positioned below the entry opening 91. As shown in FIG. 4, the rear end of the pawl pivot shaft 12S is fixed to the base plate 82 and the front end of the pawl pivot shaft 12S is fixed to the back plate 83. Although not shown in the figure, the rear end of the fork pivot shaft 11S is also fixed to the base plate 82 and the front end of the fork pivot shaft 11S is also fixed to the back plate 83.

As shown in FIG. 3, the fork 11 is pivotably supported by the fork pivot shaft 11S in a state in which the fork 11 is sandwiched from the front and the rear by the base plate 82 and the back plate 83 in the internal space 81S. As shown in FIG. 5, the fork 11 is biased by a torsion coil spring 11T (shown in FIG. 3) to pivot in a direction D1 around the fork pivot shaft 11S.

A part of the fork 11 positioned on the side of the entry opening 91 branches to an interior convex portion 11A and an exterior convex portion 11B. The striker 99 entering the entry opening 91 fits in a concave portion 11C formed between the interior convex portion 11A and the exterior convex portion 11B. In a state shown in FIG. 5, the fork 11 retains the striker 99 at the bottom of the entry opening 91. A latch surface 11D that can come into contact with a stopper surface 12A, which will be described later, is formed on a distal end side of the interior convex portion 11A facing the pawl 12.

As shown in FIG. 3 and FIG. 4, the pawl 12 is pivotable by the pawl pivot shaft 12S in a state in which the pawl 12 is sandwiched from the front and the rear by the base plate 82 and the back plate 83 in the internal space 81S. As shown in FIG. 5, the pawl 12 is biased by a torsion coil spring 12T (shown in FIG. 3) to pivot in a direction D2 around the pawl pivot shaft 12S. The pawl 12 is normally maintained in the orientation shown in FIG. 5.

A part of the pawl 12 positioned on a bottom side of the entry opening 91 is formed with the stopper surface 12A. The stopper surface 12A is a curved surface curving in an arcuate shape centering on the axis of the pawl pivot shaft 12S and is formed to face the latch surface 11D. The arc forming the stopper surface 12A breaks off on the side of the fork 11, and a sliding surface 12C extending to the side of the pawl pivot shaft 12S is formed therefrom. On the other hand, on the opposite side of the stopper surface 12A across the pawl pivot shaft 12S in the pawl 12, as shown in FIG. 3 and FIG. 4, a contacted portion 12B projecting forward in a columnar shape is formed.

As shown in FIG. 5, in a state in which the fork 11 retains the striker 99 in the bottom of the entry opening 91, the stopper surface 12A comes into contact with the latch surface 11D of the interior convex portion 11A, whereby the pawl 12 fixes the fork 11 not to pivot in the direction D1. Consequently, the fork 11 is switched to a latched state for locking the striker 99 in the entry opening 91.

Figure 6:
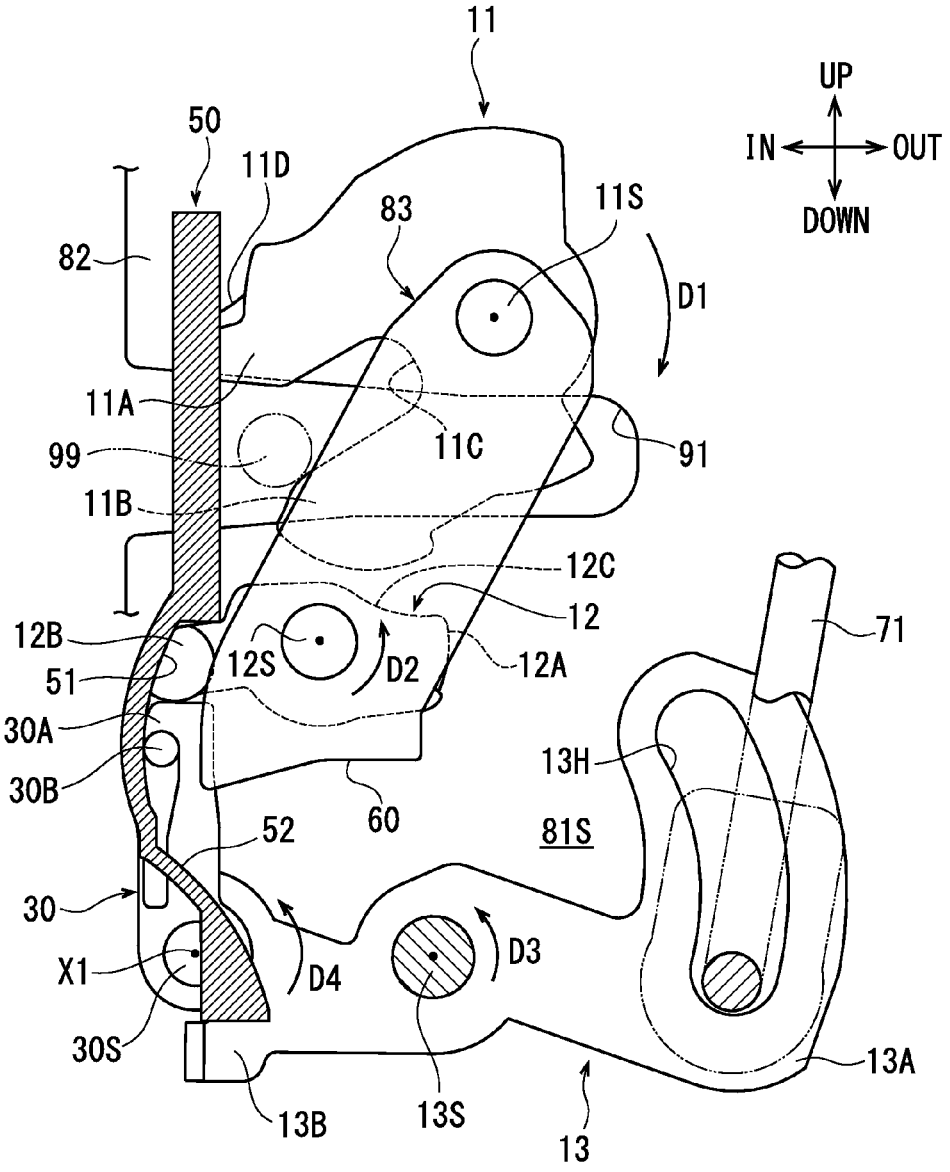
FIG. 6 is a schematic sectional view of the vehicle door lock apparatus in the embodiment, showing the fork, the pawl, the first to third levers, the retention device, and the like viewed along the section B-B in FIG. 4.

As shown in FIG. 6, when a below-described contact portion 30A of the inertial lever 30 comes into contact with and pushes up the contacted portion 12B of the pawl 12, the pawl 12 pivots in a direction opposite to the direction D2 around the pawl pivot shaft 12S while resisting a biasing force of the torsion coil spring 12T. At this time, since the stopper surface 12A separates from the latch surface 11D, the pawl 12 releases the pivoting of the fork 11. Then, the fork 11 pivots in the direction D1 around the fork pivot shaft 11S with a biasing force of the torsion coil spring 11T and displaces the striker 99 in a direction in which the striker 99 separates from the entry opening 91. As a result, the fork 11 is switched to an unlatched state for releasing the locking of the striker 99 in the entry opening 91.

Conversely, when the striker 99 enters the entry opening 91, since the striker 99 pushes the exterior convex portion 11B, the fork 11 also pivots in a direction opposite to the direction D1 following the exterior convex portion 11B and returns from a state shown in FIG. 6 to the state shown in FIG. 5. At this time, the distal ends of the exterior convex portion 11B and the interior convex portion 11A sequentially come into slide contact with the sliding surface 12C. When the interior convex portion 11A separates from the sliding surface 12C, since the pawl 12 pivots in the direction D2 and returns to its original state shown in FIG. 5, the stopper surface 12A faces the latch surface 11D and fixes the pivoting of the fork 11.

As shown in FIG. 3 and FIG. 5, the open lever 13 is provided below the pawl 12 in the internal space 81S. The open lever 13 is made of a metal steel plate and is pivotably supported around an open lever pivot shaft 13S. As shown in FIG. 5, the open lever 13 is biased by a torsion coil spring 13T (shown in FIG. 3) to pivot in a direction D3 around the open lever pivot shaft 13S and stopped by abutting a not-shown stopper. Consequently, the open lever 13 is normally maintained in the orientation shown in FIG. 5. In this state, an interior end portion 13B of the open lever 13 is positioned below the contacted portion 12B of the pawl 12.

The lower end portion of the rod 71 is inserted into a long hole 13H formed in an exterior end portion 13A of the open lever 13. When the opening operation of the exterior door handle 8 is performed and the rod 71 moves downward, as shown in FIG. 6, the lower end portion of the rod 71 comes into contact with the lower end of the long hole 13H and pushes down the exterior end portion 13A. As a result, the open lever 13 pivots in a direction opposite to the direction D3 and the interior end portion 13B of the open lever 13 moves upward.

As shown in FIG. 3, a movable member pivot shaft 87S projecting toward the inner side is protrudingly provided in the internal space 81S. A movable member 87 is pivotably supported by the movable member pivot shaft 87S. Although not shown in the figure, the cable 72 is coupled to the movable member 87. When the opening operation of the interior door handle 7 is performed and the cable 72 is actuated, the movable member 87 pivots around the movable member pivot shaft 87S and, as shown in FIG. 4 and FIG. 5, the movable member 87 is displaced to push up the interior end portion 13B of the open lever 13 from below. At this time, although the exterior end portion 13A of the open lever 13 is displaced downward, since the lower end portion of the rod 71 is relatively displaced along the long hole 13H, the pivoting of the open lever 13 is not hindered.

In this way, the open lever 13 is configured to pivot around the open lever pivot shaft 13S according to the opening operation of the exterior door handle 8 or the interior door handle 7, displace the interior end portion 13B in the up-down direction, and bring the interior end portion 13B close to the contacted portion 12B of the pawl 12.

As shown in FIG. 3 to FIG. 5, an inertial lever pivot shaft 30S is fit in the interior end portion 13B of the open lever 13. The inertial lever pivot shaft 30S projects frontward from the interior end portion 13B with the axis being a pivot X1 extending in the front-rear direction (a direction orthogonal to a direction of advancing to and retracting from the opening 9).

As shown in FIG. 3 and FIG. 4, the inertial lever 30 is a substantial parallelepiped elongated in the up-down direction. The inertial lever pivot shaft 30S is inserted through a lower end side of the inertial lever 30 and enables the inertial lever 30 to pivot around the pivot X1. In this embodiment, the inertial lever 30 is manufactured by zinc die cast. An upper end side of the inertial lever 30 is formed as the contact portion 30A. A sliding portion 30B projecting frontward in a columnar shape is formed on a front surface of the contact portion 30A.

A torsion coil spring 41 is provided between the inertial lever 30 and the interior end portion 13B of the open lever 13. The torsion coil spring 41 is an example of the "biasing member" in the present invention. The inertial lever pivot shaft 30S is inserted through the torsion coil spring 41 and the torsion coil spring 41 is disposed coaxially with the pivot X1 in a state in which the torsion coil spring 41 is sandwiched by the inertial lever 30 in the front and the interior end portion 13B in the rear. One end of the torsion coil spring 41 is locked to the inertial lever 30 and the other end of the torsion coil spring 41 is locked to the interior end portion 13B. Consequently, as shown in FIG. 5, the torsion coil spring 41 biases the inertial lever 30 to pivot in a direction D4 around the pivot X1.

As shown in FIG. 5, in a normal state (in a state in which an impact F0 shown in FIG. 1 does not act), the inertial lever 30 is biased by the torsion coil spring 41 and stopped by abutting a below-mentioned first guide surface 51 of the lock lever 50. The position of the inertial lever 30 shown in FIG. 5 is the first position in the present invention. That is, the torsion coil spring 41 biases the inertial lever 30 toward the first position.

Figure 7:
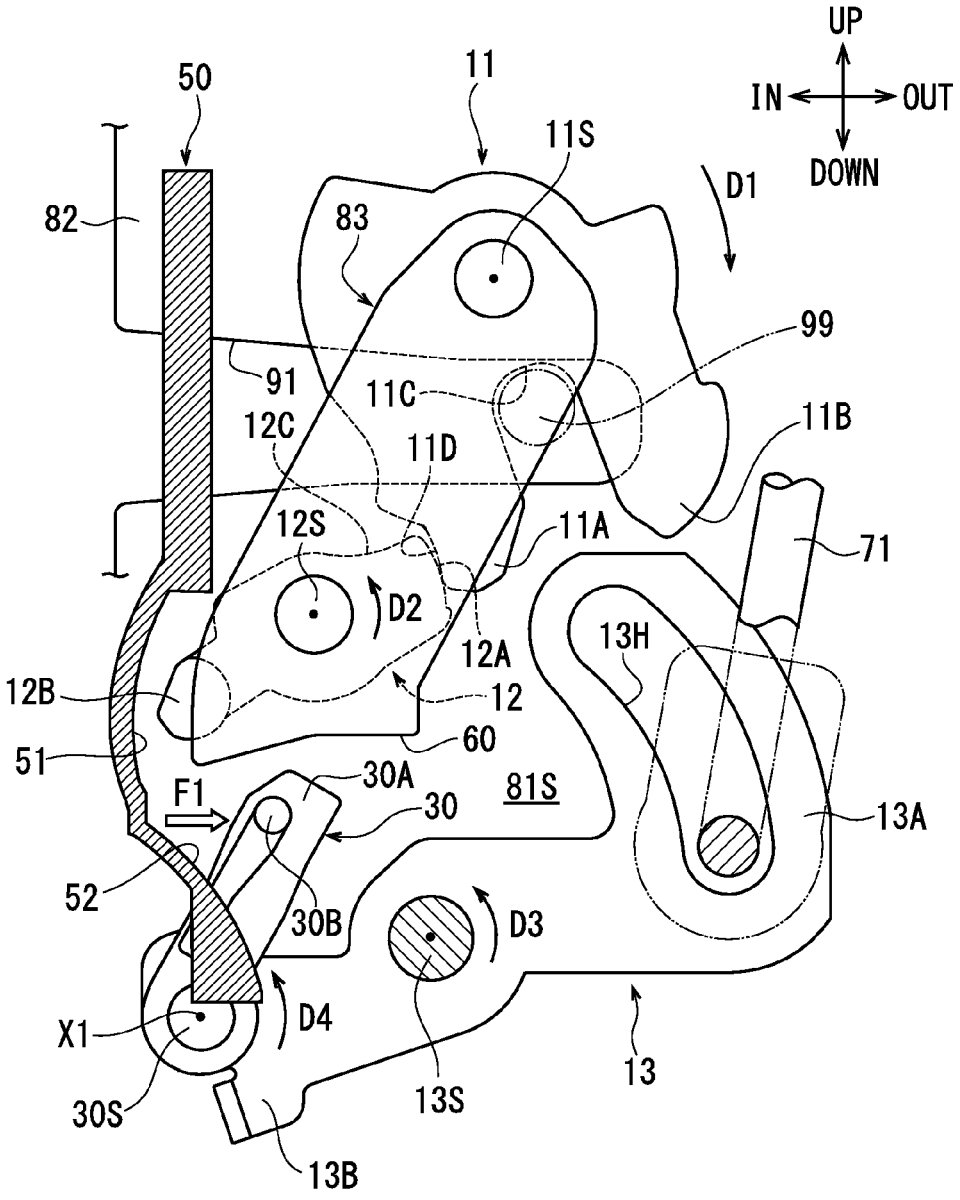
FIG. 7 is a schematic sectional view of the vehicle door lock apparatus in the embodiment, showing the fork, the pawl, the first to third levers, the retention device, and the like viewed along the section B-B in FIG. 4.

The biasing force of the torsion coil spring 41 and the weight of the inertial lever 30 (in particular, the weight of the contact portion 30A) are set such that, as shown in FIG. 7, inertial force F1 greater than a preset value is applied on the inertial lever 30, whereby the inertial lever 30 pivots from the first position to a position shown in FIG. 7 around the pivot X1 with respect to the open lever 13 while resisting the biasing force of the torsion coil spring 41. The position of the inertial lever 30 shown in FIG. 7 is the second position in the present invention. The preset value is set as appropriate on the basis of, for example, measurement data at the time of side surface collision or the like of the vehicle.

As shown in FIG. 3 to FIG. 5, the lock lever 50 is a resin member elongated in the up-down direction. The lock lever 50 is housed in front of the back plate 83 and above the interior end portion 13B of the open lever 13 and the inertial lever pivot shaft 30S in the internal space 81S. A regulating portion 81G protrudingly provided in a partition screen shape and extending in the up-down direction is formed in the first housing member 81A. The lock lever 50 is configured to come into slide contact with the regulating portion 81G and slidable in the up-down direction.

An actuator M1 is assembled above the regulating portion 81G in the first housing member 81A. The actuator M1 is a known electric driving mechanism including a driving source such as an electric motor and a driving force transmitting section such as a transmission gear or a rack gear. As schematically shown in FIG. 4, the driving force transmitting section of the actuator M1 is coupled to an upper part of the lock lever 50.

When the unlocking operation of the door 2 is performed by a not-shown key cylinder or locking knob provided in the door 2 or when the unlocking operation of the door 2 is performed by a locking and unlocking button or the like provided in a not-shown remote control key, the lock lever 50 is driven by the actuator M1 to be displaced downward and stops in a position shown in FIG. 4 and FIG. 5. The position of the lock lever 50 shown in FIG. 4 and FIG. 5 is the "third position" in the present invention.

Figure 8:
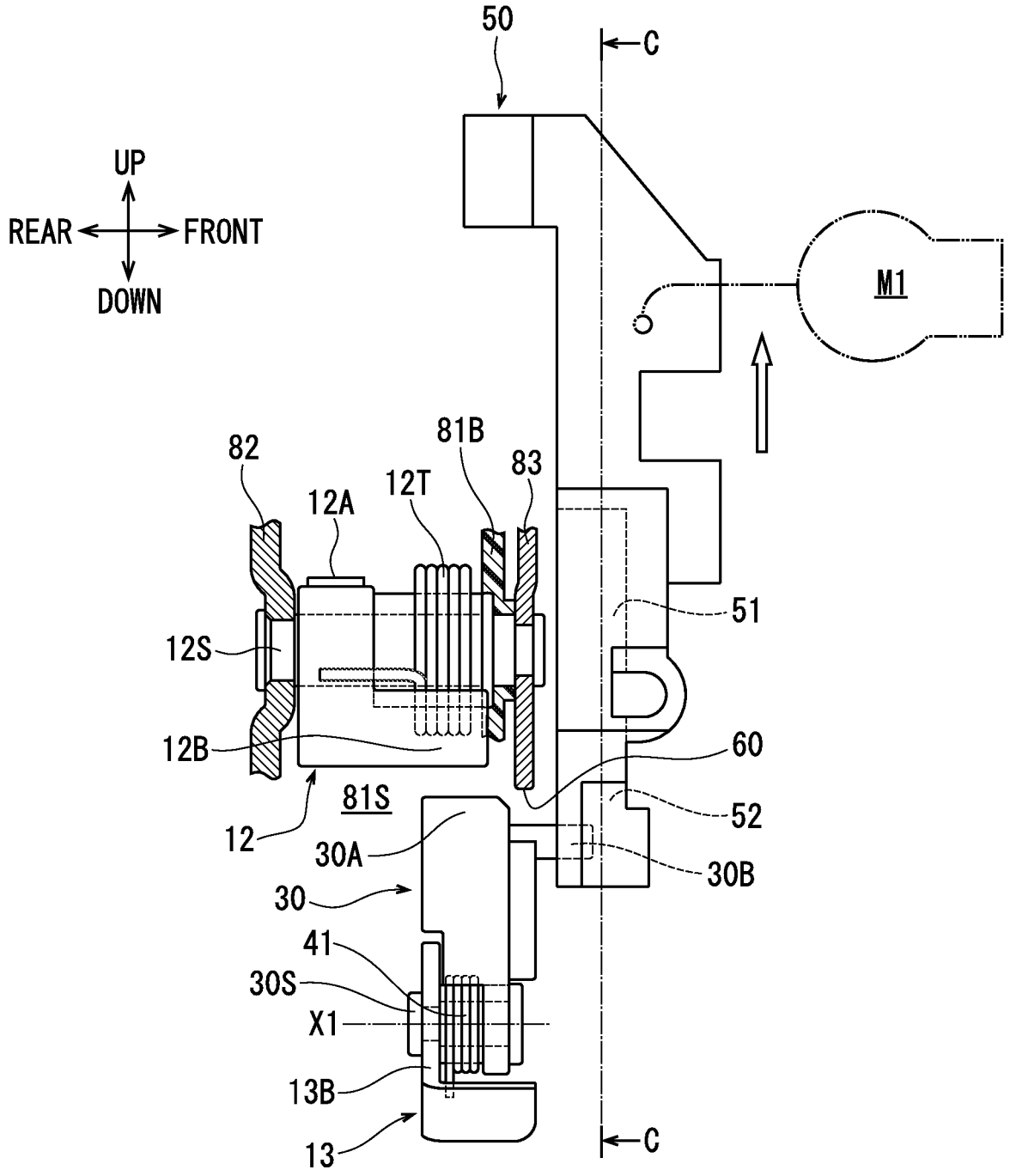
FIG. 8 is a schematic diagram of the vehicle door lock apparatus in the embodiment, extracting and showing the fork, the pawl, the first to third levers, the retention device, and the like viewed from the direction of the arrow A in FIG. 3 (in a state in which the third lever is disposed in a fourth position).
Figure 9:
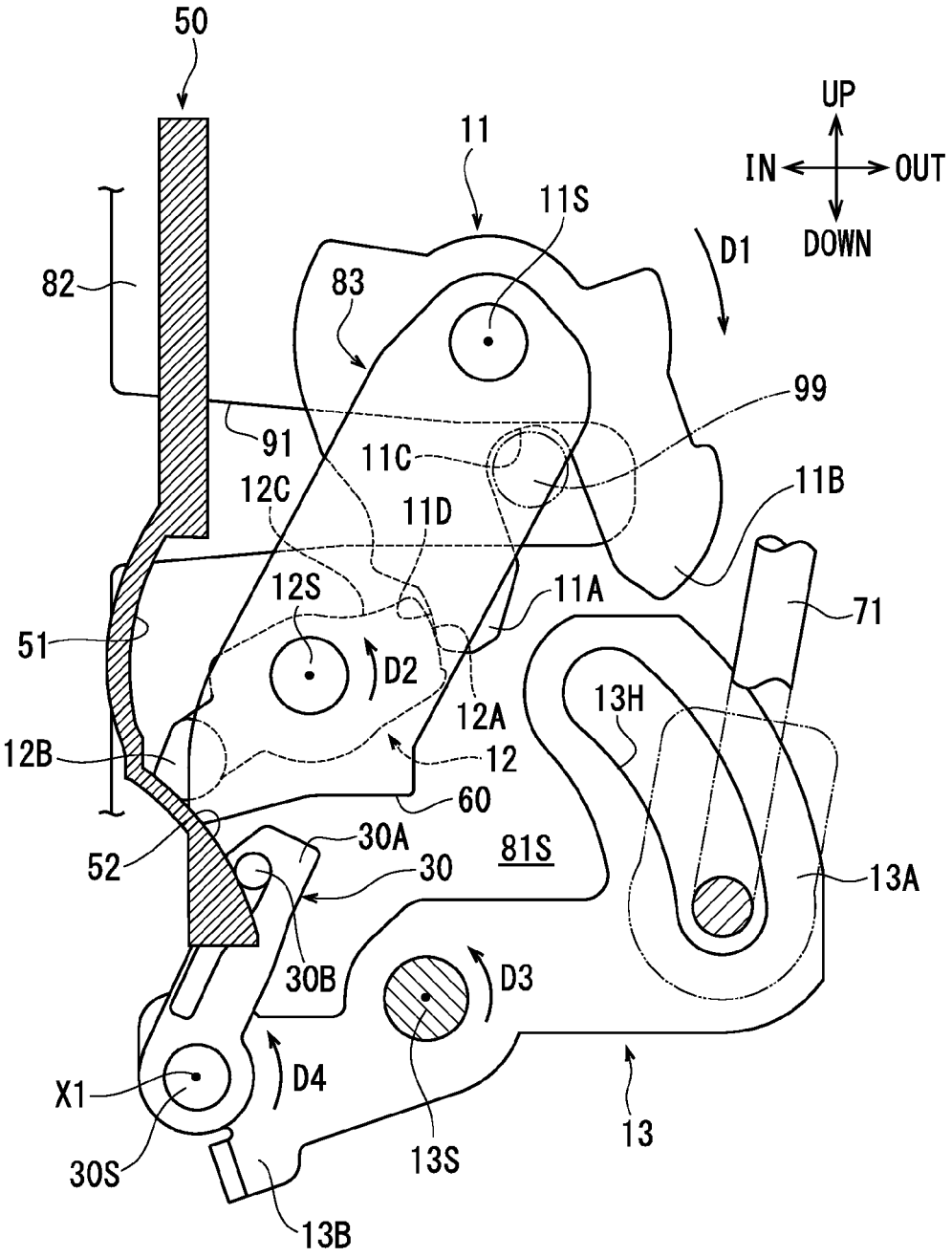
FIG. 9 is a schematic sectional view of the vehicle door lock apparatus in the embodiment, showing the fork, the pawl, the first to third levers, the retention device, and the like viewed along section C-C in FIG. 8.

On the other hand, when an locking operation of the door 2 is performed by the not-shown key cylinder or locking knob provided in the door 2 or when the locking operation of the door 2 is performed by the locking and unlocking button or the like provided in the not-shown remote control key, the lock lever 50 is driven by the actuator M1 to be displaced upward and stops in a position shown in FIG. 8 and FIG. 9. The position of the lock lever 50 shown in FIG. 8 and FIG. 9 is the "fourth position" in the present invention. The up-down direction, which is a direction in which the lock lever 50 is displaced, is the "first direction", that is, a direction substantially parallel to a direction in which the pivot X1 is displaced according to the pivoting of the open lever 13.

As shown in FIG. 3 to FIG. 5, the lock lever 50 includes the first guide surface 51 and a second guide surface 52.

As shown in FIG. 5, the first guide surface 51 is a smooth surface extending in the up-down direction while facing the outer side of the vehicle. An intermediate portion in the up-down direction of the first guide surface 51 gently bends toward the inner side of the vehicle. This is for the purpose of maintaining an upright orientation of the inertial lever 30 when the pivot X1 moves upward while tracing a gentle arced path around the open lever pivot shaft 13S.

The second guide surface 52 is a smooth surface continuing to the lower end of the first guide surface 51 and bending to swell toward the outer side of the vehicle. The direction in which the second guide surface 52 swells can be rephrased as "a direction orthogonal to the pivot X1 and approaching the sliding portion 30B of the inertial lever 30". A lower end edge side of the second guide surface 52 protrudes further to the outer side of the vehicle than the first guide surface 51.

As shown in FIG. 4 and FIG. 5, in the case in which the lock lever 50 is disposed in the third position, when the open lever 13 is not pivoting, the inertial lever 30 is biased to the direction D4 by a torsion coil spring 41; however, the lower end portion of the first guide surface 51 comes into contact with the sliding portion 30B of the inertial lever 30 from the inner side of the vehicle, whereby the inertial lever 30 is retained in the first position.

Then, when the open lever 13 pivots, the interior end portion 13B and the pivot X1 move upward and the inertial lever 30 pivotably supported around the pivot X1 is pushed up. At this time, although the inertial lever 30 is also biased in the direction D4 by the torsion coil spring 41, the first guide surface 51 comes into slide contact with the sliding portion 30B from the inner side of the vehicle, whereby the inertial lever 30 moves upward while maintaining its upright orientation and comes into contact with the contacted portion 12B. As a result, since the pawl 12 and the fork 11 operate as explained above, the fork 11 in the latched state can be switched to the unlatched state.

As shown in FIG. 7, when the inertial force F1 is applied on the inertial lever 30, since the first guide surface 51 is positioned on the inner side of the vehicle with respect to the sliding portion 30B and does not prohibit the sliding portion 30B from being displaced to the outer side of the vehicle, the inertial lever 30 can pivot to the second position.

In short, the lock lever 50 allows, in the third position, the inertial lever 30 to be disposed in the first position and the second position and achieves a state in which the fork 11 in the latched state can be switched to the unlatched state. In this way, the lock lever 50 switches the door lock apparatus 1 to an unlocked state.

On the other hand, as shown in FIG. 8 and FIG. 9, in the case in which the open lever 13 is not pivoting, when the locking operation of the door 2 is performed by the key cylinder or the like, the lock lever 50 is driven by the actuator M1 and moves upward from the third position to the fourth position. Then, the second guide surface 52 bending to project to the outer side of the vehicle comes into slide contact with the sliding portion 30B of the inertial lever 30 from the inner side of the vehicle, whereby the inertial lever 30 pivots in a direction opposite to the direction D4 while resisting the biasing force of the torsion coil spring 41 and is retained in the second position. Therefore, even if the open lever 13 pivots, the inertial lever 30 retained in the second position does not come into contact with the contacted portion 12B of the pawl 12.

In short, the lock lever 50 retains, in the fourth position, the inertial lever 30 in the second position and achieves a state in which the fork 11 in the latched state cannot be switched to the unlatched state. In this way, the lock lever 50 switches the door lock apparatus 1 to a locked state.

As shown in FIG. 4 and FIG. 5, the lower end edge of the back plate 83 faces the sliding portion 30B of the inertial lever 30 from above and extends with a gentle upward inclination from the inner side toward the outer side of the vehicle. The lower end edge of the back plate 83 serves as a retention device 60.

Figure 10:
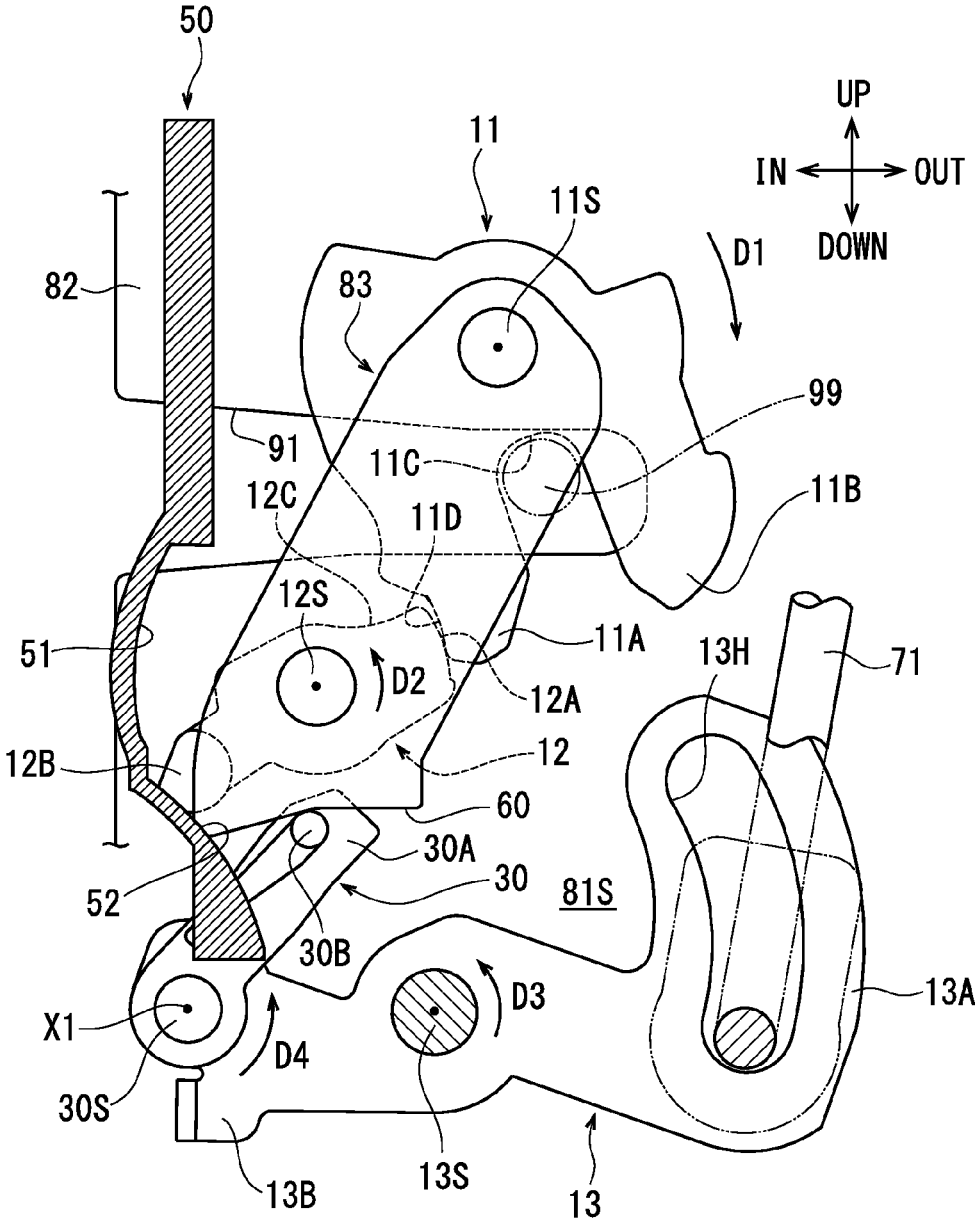
FIG. 10 is a schematic sectional view of the vehicle door lock apparatus in the embodiment, showing the fork, the pawl, the first to third levers, the retention device, and the like viewed along the section C-C in FIG. 8.

As shown in FIG. 10, in the case in which the lock lever 50 is disposed in the fourth position, when the open lever 13 pivots, the inertial lever 30 in contact with the second guide surface 52 and retained in the second position also moves upward. At this time, although the inertial lever 30 is biased in the direction D4 by the torsion coil spring 41, the retention device 60 comes into contact with the sliding portion 30B of the inertial lever 30, whereby the inertial lever 30 is retained in the second position and a state in which the contact portion 30A of the inertial lever 30 is separated from the contacted portion 12B of the pawl 12 is maintained. At this time, since the sliding portion 30B can come into slide contact with the retention device 60 to be displaced, the inertial lever 30 does not function as a "stopper rod" for restraining the open lever 13. Therefore, the pivoting movement of the open lever 13 is allowed.

Figure 11:
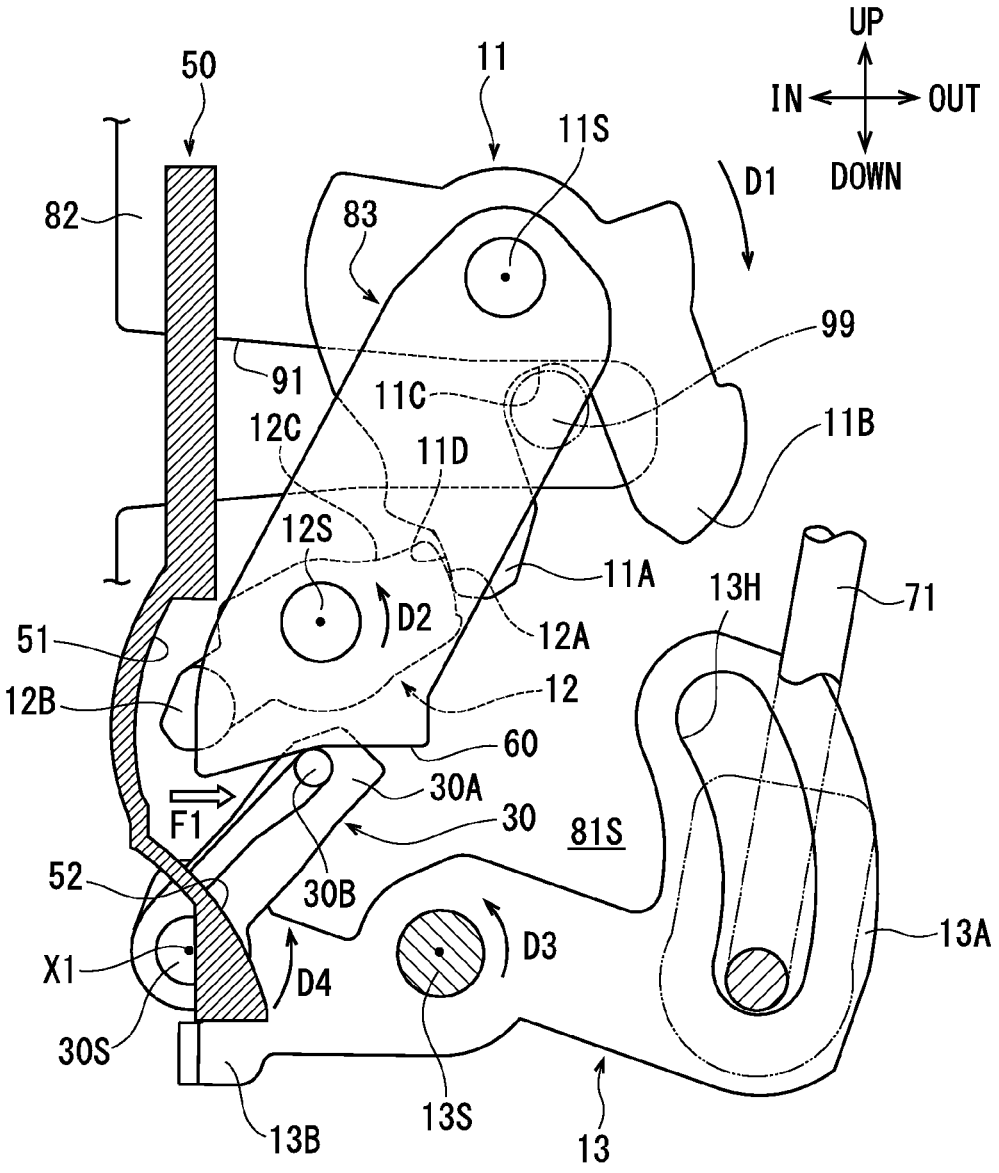
FIG. 11 is a schematic sectional view of the vehicle door lock apparatus in the embodiment, showing the fork, the pawl, the first to third levers, the retention device, and the like viewed along the section B-B in FIG. 4.

As shown in FIG. 11, in the case in which the lock lever 50 is disposed in the third position, when the inertial force F1 is applied and the inertial lever 30 pivots to the second position and the open lever 13 pivots, the retention device 60 also comes into contact with the sliding portion 30B of the inertial lever 30, whereby the inertial lever 30 is retained in the second position and the state in which the contact portion 30A of the inertial lever 30 is separated from the contacted portion 12B of the pawl 12 is maintained.

<Operational Effects>

In the door lock apparatus 1 in the embodiment, as shown in FIG. 5, in the case in which the lock lever 50 is disposed in the third position and achieves the state in which the fork 11 in the latched state can be switched to the unlatched state and in which the door lock apparatus 1 is in the unlocked state, or, as shown in FIG. 9, in the case in which the lock lever 50 is disposed in the fourth position and achieves the state in which the fork 11 in the latched state cannot be switched to the unlatched state and in which the door lock apparatus 1 is in the locked state, the pawl 12 fixes the pivoting movement of the fork 11 while the fork 11 retains the striker at the bottom of the entry opening 91, and in this manner, the fork 11 is switched to the latched state. As a result, the door lock apparatus 1 retains the door 2 in the closed state.

Further, as shown in FIG. 6, in the case in which the lock lever 50 is disposed in the third position and achieves the state in which the fork 11 in the latched state can be switched to the unlatched state and in which the door lock apparatus 1 is in the unlocked state, when a driver or a passenger operates the exterior door handle 8 or the interior door handle 7 and the rod 71 or the cable 72 operates, the interior end portion 13B of the open lever 13 and the inertial lever pivot shaft 30S are displaced upward and pushup the inertial lever 30. Then, the first guide surface 51 comes into slide contact with the sliding portion 30B of the inertial lever 30, which is displaced according to the pivoting of the open lever 13, while allowing the sliding portion 30B to pivot to the second position and retains the inertial lever 30 in the first position. Therefore, the inertial lever 30 moves upward in an upright state and the contact portion 30A comes into contact with the contacted portion 12B of the pawl 12. Consequently, since the pawl 12 and the fork 11 operate as explained above and the pawl 12 releases the pivoting of the fork 11, the fork 11 is switched to the unlatched state. As a result, the door lock apparatus 1 stops holding the door 2 and the driver or the passenger can open the door 2.

Conversely, when the driver or the passenger attempts to close the door 2, since the fork 11 is pushed by the striker 99 which has entered the entry opening 91 and returns from the state shown in FIG. 6 to the state shown in FIG. 5, the pawl 12 and the fork 11 operate as explained above, and the pawl 12 fixes the pivoting movement of the fork 11, so that the fork 11 returns to the latched state. As a result, the door lock apparatus 1 retains the door 2 in the closed state again. Although FIG. 6 shows a state in which the rod 71 has moved downward, when the driver or the passenger attempts to close the door 2, since the opening operation of the exterior door handle 8 has already been finished, the rod 71 has been actually returned to its original position shown in FIG. 5.

In the case in which the lock lever 50 is disposed in the third position and achieves the state in which the fork 11 in the latched state can be switched to the unlatched state and in which the door lock apparatus 1 is in the unlocked state, when the door 2 or the vehicle receives the impact F0 from the outside of the vehicle as shown in FIG. 1 due to, for example, the vehicle collision, as shown in FIG. 7, inertial force is applied on the inertial lever 30 in a direction opposite to the direction of the impact. Then, if the inertial force is the inertial force F1 greater than the preset value, the inertial lever 30 pivots from the first position to the second position in the direction opposite to the direction of the impact around the pivot X1 while resisting the biasing force of the torsion coil spring 41. At this time, since the first guide surface 51 is positioned on the inner side of the vehicle with respect to the sliding portion 30B and does not prohibit the sliding portion 30B from being displaced to the outer side of the vehicle, the pivoting movement of the inertial lever 30 to the second position is allowed.

The rod 71 is a rigid rod body and is coupled to the exterior door handle 8 exposed to the outer surface of the door 2. Therefore, in the case in which the door 2 is deformed according to the impact F0 and a relative positional relation between the exterior door handle 8 and the housing 80 is reduced, the rod 71 is displaced downward relative to the housing 80. Since the exterior door handle 8 is also a mass body, when the vehicle receives the impact F0, inertial force (not illustrated) is also applied on the exterior door handle 8 in the direction opposite to the direction of the impact. Then, as in the case in which the driver or the passenger performs the opening operation of the door 2, the exterior door handle 8 is displaced and the rod 71 coupled to the exterior door handle 8 is displaced downward. If the rod 71 is displaced downward by the impact F0, a deficiency occurs in which the open lever 13 pivots unintentionally. However, even in such a case, as explained above, the inertial lever 30 pivots to the second position and the contact portion 30A is not disposed right under the contacted portion 12B of the pawl 12. As shown in FIG. 11, even if the inertial lever 30 moves upward according to the pivoting of the open lever 13, the retention device 60 comes into contact with the sliding portion 30B and retains the inertial lever 30 in the second position. Therefore, even if the open lever 13 pivots unintentionally, the contact portion 30A of the inertial lever 30 disposed in the second position is in a "swing-and-miss state" in which the contact portion 30A avoids contact with the contacted portion 12B of the pawl 12.

In this way, when the impact or the like is applied, since the pivoting of the open lever 13 is not transmitted to the pawl 12, the pawl 12 continues to fix the pivoting movement of the fork 11 and the fork 11 is not switched from the latched state to the unlatched state. Although not explained in details, the same applies in the case in which the cable 72 and the movable member 87 are displaced unintentionally because of, for example, deformation of the door 2 at the time of the collision or the like.

In the case in which the lock lever 50 is disposed in the fourth position and achieves the state in which the fork 11 in the latched state cannot be switched to the unlatched state and in which the door lock apparatus 1 is in the locked state, when the open lever 13 pivots unintentionally due to, for example, the vehicle collision, as shown in FIG. 10, the inertial lever 30 is retained in the second position by the second guide surface 52 and the retention device 60. Consequently, the pawl 12 continues to fix the pivoting movement of the fork 11 and the fork 11 is not switched from the latched state to the unlatched state.

As shown in FIG. 5 and FIG. 9, in the door lock apparatus 1, the lock lever 50 is displaced to the third position or the fourth position and one of the first guide surface 51 and the second guide surface 52 comes into contact with the sliding portion 30B of the inertial lever 30, whereby it is possible to switch the door lock apparatus 1 to the unlocked state and the locked state.

In the case in which the unlocking operation and the opening operation of the door 2 overlap, in other words, in the case in which the exterior door handle 8 or the interior door handle 7 is pulled early halfway in the unlocking operation, the displacement of the lock lever 50 from the fourth position to the third position overlaps with the pivoting movement of the open lever 13 and thereby the door lock apparatus 1 becomes one of the following states: a state shown in FIG. 10, a state shown in FIG. 11, or a state between the state shown in FIG. 10 and the state shown in FIG. 11. Even in this case, as shown in FIG. 10 or FIG. 11, irrespective of whether the lock lever 50 is in the third position or the fourth position, the retention device 60 comes into contact with the sliding portion 30B and allows the pivoting movement of the open lever 13 while retaining the inertial lever 30, which is biased by the torsion coil spring 41 and about to be displaced to the first position, in the second position. Therefore, the inertial lever 30 does not function as the "stopper rod" for restraining the pivoting movement of the open lever 13 and remains separated from the pawl 12. As a result, even if the open lever 13 pivots, the contact portion 30A of the inertial lever 30 does not come into contact with the contacted portion 12B of the pawl 12 and the opening operation of the door 2 is invalidated.

On the other hand, since the lock lever 50 is displaced from the fourth position to the third position shown in FIG. 5 and achieves the states in which the fork 11 in the latched state can be switched to the unlatched state and in which the door lock apparatus 1 is switched to the unlocked state without being hindered by the open lever 13 and the inertial lever 30, it is unnecessary to perform the unlocking operation again. If the open lever 13 returns to the original position, the inertial lever 30 is allowed by the lock lever 50 disposed in the third position to be displaced from the second position shown in FIG. 10 or FIG. 11 to the first position shown in FIG. 5 by the biasing force of the torsion coil spring 41 and comes into contact with the first guide surface 51. Therefore, in the case in which the opening operation of the door 2 is performed next, as shown in FIG. 6, the sliding portion 30B comes into slide contact with the first guide surface 51 and the inertial lever 30 can move upward in the upright state and surely come into contact with the pawl 12.

Further, in the door lock apparatus 1, the inertial lever 30 serves as all of a member that comes into contact with the pawl 12 due to the opening operation of the door 2, a member that is separated from the pawl 12 by the inertial force F1 at the time of, for example, the impact on the vehicle, and a member that eliminates the need to perform the unlocking operation again in the case in which the unlocking operation and the opening operation of the door 2 overlap. Further, only one torsion coil spring 41 is sufficient as the biasing member with respect to the inertial lever 30 which serves as the three members; therefore, in the door lock apparatus 1, it is possible to realize a reduction in the number of components and simplification of assembly work and thus realize a reduction in manufacturing costs.

Therefore, in the door lock apparatus 1 in the embodiment, it is possible to reduce manufacturing costs while realizing prevention of the unintentional opening of the door 2 at the time of, for example, the vehicle collision and elimination of the need to perform the unlocking operation again when the unlocking operation and the opening operation of the door 2 overlap. In the door lock apparatus 1, it is also possible to realize a reduction in size because one torsion coil spring 41 is sufficient as the biasing member with respect to the inertial lever 30 which serves as the three members.

In the door lock apparatus 1, the lock lever 50 is configured to move linearly in the up-down direction (the first direction substantially parallel to the direction in which the pivot X1 is displaced) according to the pivoting of the open lever 13 and to be displaced to the third position or the fourth position. Consequently, in the door lock apparatus 1, it is possible to reduce a space occupied by the lock lever 50 and thus realize a reduction in size of the apparatus.

Further, in the door lock apparatus 1, with the configuration in which the lock lever 50 includes the first guide surface 51 and the second guide surface 52, it is possible to simplify an apparatus configuration and realize a further reduction in manufacturing costs.

Further, in the door lock apparatus 1, by forming the lower end edge facing the inertial lever 30 of the back plate 83 as the retention device 60, it is possible to easily form the retention device 60, and therefore, a further reduction in manufacturing costs can be realized.

The present invention has been explained above in line with the embodiment; however it is needless to say that the present invention is not limited to the embodiment and may be appropriately modified in application without departing from the gist of the invention.

Although the retention device 60 is provided in the back plate 83 in the embodiment, the present invention is not limited to this configuration. The retention device may be provided in, for example, the main housing 81 or the base plate 82. The retention device may be assembled in the housing space 81S as a separate member.

In the embodiment, although the lock lever 50, which is an example of the third lever, moves linearly in the up-down direction, the present invention is not limited to this configuration. The third lever may move linearly in a direction other than the up-down direction or may pivot.

In the embodiment, although the torsion coil spring 41, which is an example of the biasing member, is provided to be sandwiched from the front and the rear by the open lever 13, which is an example of the first lever, and the inertial lever 30, which is an example of the second lever, the present invention is not limited to this configuration. For example, the torsion coil spring 41 may be transferred to a place different from the place in the embodiment, one end of the torsion coil spring 41 may be locked to the open lever 13, and the other end of the torsion coil spring 41 may be locked to the inertial lever 30. The biasing member may be a tension coil spring or may be provided between the housing and the second lever.

In the embodiment, with respect to the open lever 13 as an example of the first lever, although the interior end portion 13B, at which the inertial lever 13 is supported, is positioned on the opposite side of the exterior end portion 13A, to which the rod 71 is coupled, across the open lever pivot shaft 13S, the present invention is not limited to this configuration. The other end side of the first lever means a part other than the one end side of the first lever and does not need to be disposed on the opposite side of the one end side.

In this embodiment, although the lock lever 50, which is an example of the third lever, is driven by the actuator M1 and displaced to the third position and the fourth position, the present invention is not limited to this configuration. For example, the lock lever 50 may be coupled to the key cylinder or the locking knob via a mechanical transmission mechanism such as a rod or a cable and displaced to the third position and the fourth position due to the locking and unlocking operation of the key cylinder or the locking knob.

INDUSTRIAL APPLICABILITY

The present invention is applicable to vehicles such as automobiles, buses, and industrial vehicles.

EXPLANATION OF THE REFERENCE NUMBERS

1 . . . Vehicle door lock apparatus
9 . . . Opening
2 . . . Door
99 . . . Striker
91 . . . Entry opening
80 . . . Housing
11 . . . Fork
12 . . . Pawl
7, 8 . . . Door handles (8 . . . Exterior door handle, 7 . . . Interior door handle)
13 . . . First lever (Open lever)
13A . . . One end (exterior end portion) of the first lever
13B . . . Other end (interior end portion) of the first lever
X1 . . . Pivot
F1 . . . Inertial force greater than a preset value
30 . . . Second lever (Inertial lever)
41 . . . Biasing member (Torsion coil spring)
50 . . . Third lever (Lock lever)
60 . . . Retention device (End edge of a back plate facing the second lever)
51 . . . First guide surface
52 . . . Second guide surface
82 . . . Base plate
83 . . . Back plate

The invention claimed is:

1. A vehicle door lock apparatus comprising:

a housing provided in a door for opening and closing an opening of a vehicle body and including an entry opening that a striker fixed to the vehicle body enters;

a fork pivotably provided in the housing and switchable between a latched state for locking the striker in the entry opening and an unlatched state for unlocking the striker in the entry opening;

a pawl pivotably provided in the housing and configured to selectively prevent and allow pivoting movement of the fork;

a first lever pivotably provided in the housing, one end side of which is coupled to a door handle, and configured to pivot by an opening operation of the door handle;

a second lever pivotably supported on the other end side of the first lever around a pivot extending in a direction orthogonal to a direction of advancing to and retracting from the opening, enabled to pivot from a first position to a second position by application of inertial force greater than a preset value, and configured to, when the first lever pivots and the second lever is in the first position, come into contact with the pawl and release the pivoting movement of the fork and when the first lever pivots and the second lever is in the second position, move independently of the pawl;

a biasing member configured to bias the second lever to the first position;

a third lever provided in the housing, displaceable between a third position for allowing the second lever to be disposed in the first position and the second position and a fourth position for retaining the second lever in the second position, and configured to, in the third position, switch the vehicle door lock apparatus to an unlocked state in which the fork in the latched state can be switched to the unlatched state and in the fourth position, switch the vehicle door lock apparatus to a locked state in which the fork in the latched state cannot be switched to the unlatched state; and a retention device provided in the housing and configured to, when the first lever pivots and the second lever is disposed in the second position, allow the pivoting movement of the first lever while retaining the second lever in the second position irrespective of the position of the third lever.

2. The vehicle door lock apparatus according to claim 1, wherein the third lever is configured to move linearly in a first direction substantially parallel to a direction in which the pivot is displaced according to the pivoting movement of the first lever and to be displaced to the third position or the fourth position.

3. The vehicle door lock apparatus according to claim 2, wherein the third lever includes a first guide surface extending in the first direction and a second guide surface continuing to the first guide surface, orthogonal to the pivot, and bending to swell in a direction approaching the second lever, the first guide surface is configured to, when the third lever is disposed in the third position, retain the second lever in the first position in a slide contact manner and allow the second lever to pivot to the second position when the second lever is being displaced according to the pivoting movement of the first lever, and the second guide surface is configured to, when the third lever is disposed in the fourth position, come into contact with the second lever and retain the second lever in the second position.

4. The vehicle door lock apparatus according to claim 3, wherein the housing includes a base plate in which the entry opening is formed and a back plate facing the base plate, the fork and the pawl are pivotably supported such that the fork and the pawl are sandwiched by the base plate and the back plate, and the retention device is an end edge of the back plate facing the second lever.

5. The vehicle door lock apparatus according to claim 1, wherein the housing includes a base plate in which the entry opening is formed and a back plate facing the base plate, the fork and the pawl are pivotably supported such that the fork and the pawl are sandwiched by the base plate and the back plate, and the retention device is an end edge of the back plate facing the second lever.

6. A vehicle door lock apparatus comprising:

a housing mountable to a door for opening and closing an opening of a vehicle body, the housing including an entry opening configured to receive a striker fixed to the vehicle body;

a fork pivotably mounted in the housing and shiftable between a latched position for holding the striker in the entry opening and an unlatched position allowing the striker to leave the entry opening;

a pawl pivotably mounted in the housing and shiftable between a blocking position that blocks the fork from shifting from the latched position to the unlatched position and an unblocking position that allows the fork to shift from the latched position to the unlatched position;

a first lever pivotably mounted in the housing, the first lever having a first end operatively connectable to a door handle such that an operation of the door handle pivots a second end of the first lever toward a release position, the second end of the first lever having a pivot;

a second lever pivotably supported on the pivot and pivotable about the pivot from a first position to a second position in response to an application of an inertial force greater than a predetermined value, the second lever being biased toward the first position by a biasing member, the second lever being configured such that pivoting the first lever when the second lever is in the first position moves the second lever and shifts the pawl from the blocking position to the unblocking position and pivoting the first lever when the second lever is in the second position moves the second lever without shifting the pawl to the unblocking position;

a third lever mounted in the housing and shiftable between a third position and a fourth position, the third lever in the third position allowing the second lever to be in the first position or the second position and the third lever in the fourth position holding the second lever out of the first position; and a retention device in the housing and configured to prevent the second lever from returning to the first position when the first lever pivots toward the release position and the second lever is in the second position.

7. The vehicle door lock apparatus according to claim 6, wherein the third lever includes a first guide surface and a second guide surface, the second guide surface being convex, the first guide surface being configured to, when the third lever is disposed in the third position, limit rotation of the second lever in a direction away from the second position and allow the second lever to pivot to the second position, and the second guide surface is configured to, when the third lever is disposed in the fourth position, contact the second lever and retain the second lever in the second position.

8. The vehicle door lock apparatus according to claim 7, wherein the housing includes a base plate in which the entry opening is formed and a back plate facing the base plate, the fork and the pawl are pivotably supported such that the fork and the pawl are sandwiched by the base plate and the back plate, and the retention device is an end edge of the back plate facing the second lever.

9. The vehicle door lock apparatus according to claim 6, wherein the housing includes a base plate in which the entry opening is formed and a back plate facing the base plate, the fork and the pawl are pivotably supported such that the fork and the pawl are sandwiched by the base plate and the back plate, and the retention device is an end edge of the back plate facing the second lever.

10. The vehicle door lock apparatus according to claim 9, wherein:

the housing further comprises a main housing affixed to the base plate and to the back plate and the back plate is made of a metal steel plate.

11. The vehicle door lock apparatus according to claim 6, wherein:

the housing includes a base plate in which the entry opening is formed and a main housing affixed to the base plate, the fork and the pawl are pivotably supported such that the fork and the pawl are sandwiched by the base plate and the main housing, and the retention device is provided in the main housing facing the second lever.

12. The vehicle door lock apparatus according to claim 11, wherein the main housing is made of resin.

13. The vehicle door lock apparatus according to claim 11, wherein:

the main housing includes a first housing member joined to a second housing member, the fork and the pawl are pivotably supported such that the fork and the pawl are sandwiched by the base plate and the second housing member, and the retention device is provided in the second housing member.

14. The vehicle door lock apparatus according to claim 13, wherein the second housing member is made of resin.

15. The vehicle door lock apparatus according to claim 14, wherein the first housing member is made of resin.

* * * * *